US011786439B1

(12) United States Patent
Egnoski

(10) Patent No.: US 11,786,439 B1
(45) Date of Patent: Oct. 17, 2023

(54) MASSAGE DEVICE

(71) Applicant: Robert L Egnoski, Irving, TX (US)

(72) Inventor: Robert L Egnoski, Irving, TX (US)

( * ) Notice: Subject to any disclaimer, the term of this patent is extended or adjusted under 35 U.S.C. 154(b) by 158 days.

(21) Appl. No.: 17/367,356

(22) Filed: Jul. 3, 2021

(51) Int. Cl.
*A61H 23/00* (2006.01)
*A61H 23/02* (2006.01)

(52) U.S. Cl.
CPC ..... *A61H 23/006* (2013.01); *A61H 23/0263* (2013.01); *A61H 2023/002* (2013.01); *A61H 2201/1418* (2013.01); *A61H 2201/1654* (2013.01)

(58) Field of Classification Search
CPC ..... A61H 23/0254; A61H 23/006; A61H 23/0263; A61H 2201/1418; A61H 2201/1654
See application file for complete search history.

(56) References Cited

U.S. PATENT DOCUMENTS 3,445,877 A * 5/1969 Stout ..... A47L 11/4069 15/98
4,965,905 A * 10/1990 Kitahata ..... A47L 11/4036 15/97.1
5,713,758 A * 2/1998 Goodin ..... H01R 13/639 439/459
2021/0401663 A1* 12/2021 Wersland ..... A61H 23/02

* cited by examiner

*Primary Examiner* — Steven O Douglas
(74) *Attorney, Agent, or Firm* — Jeffrey Roddy

(57) ABSTRACT

A massage device includes a coupling member adapted for attachment to a power output shaft, a proximal foam pad attached to the coupling member, and, a distal foam pad bottom. Portions of the distal foam pad are adapted to cover over at least one side of the proximal foam pad and form a highly resilient curved surface. A removable bonnet shaped and sized to tightly fit over the distal foam pad and proximal foam pad includes an outer surface with a low coefficient of friction that may be applied to over the clothing without grabbing for providing a softer and safer percussive massage.

7 Claims, 4 Drawing Sheets

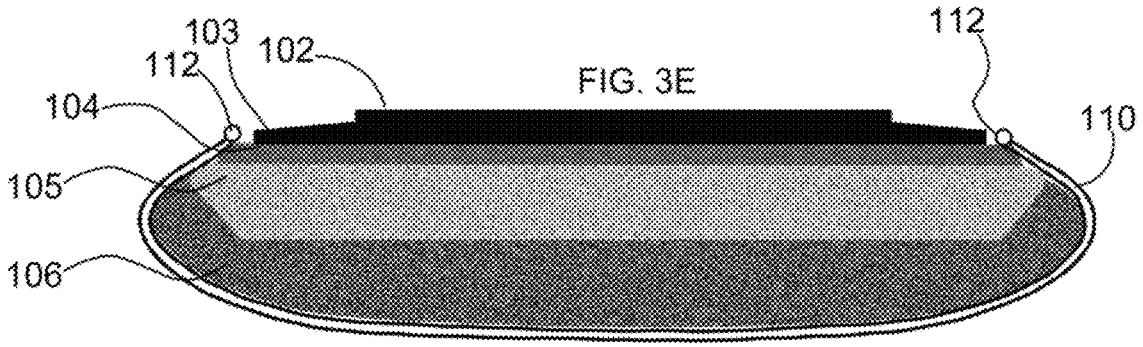
FIG. 3E
FIG. 4
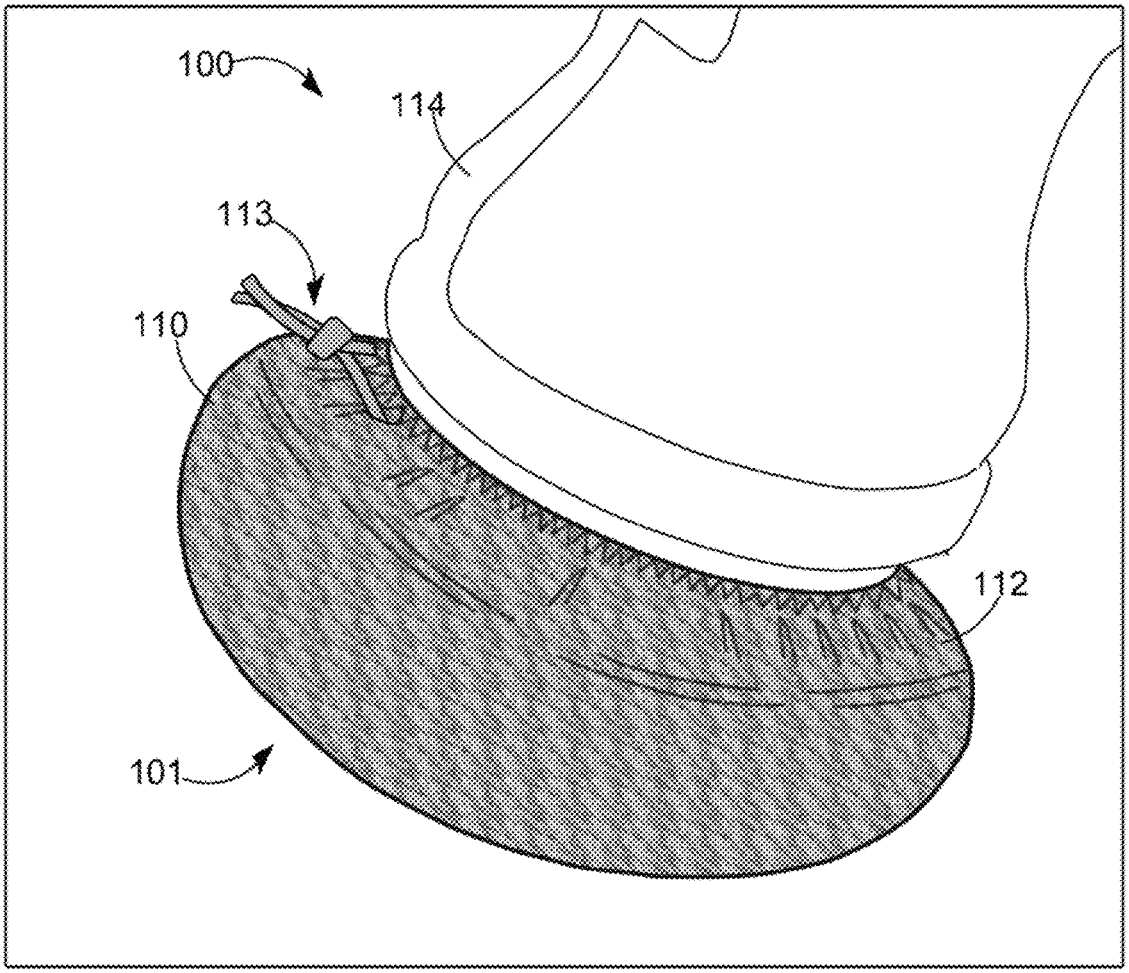

MASSAGE DEVICE

TECHNICAL FIELD

The invention relates generally to massage devices and more particularly orbital and percussive type massage devices and methods.

BACKGROUND

Percussive massage devices are known in the art. In some instances, orbital-type devices not specifically designed for massage, such as orbital polisher/buffers, have been adapted for percussive massage use, by using an edge of the buffer pad against muscle groups of the human body. However, while the foregoing devices are less costly than purpose built massage units, the typical stacked pad arrangement of the foregoing devices is not well suited to percussive massage and for reasons that will be explained in the following disclosure, tend to impact muscle tissue in a manner that is excessively rough.

It would be desirable to provide a pad assembly for an orbital-type device specially configured for softer and safer percussion of muscle tissue when the edge of the pad assembly is placed against the body.

It would be desirable to provide a pad assembly for an orbital-type device that does not grab or overheat muscle tissue when the bottom of the pad assembly is placed against the body.

It would be further desirable if the foregoing pad assembly were capable of being paired with the mechanism common to orbital polisher/buffers.

SUMMARY

In a general example implementation of the present invention, a massage device includes a coupling member adapted for attachment to a power output shaft, a proximal foam pad attached to the coupling member, and, a distal foam pad. The distal foam pad has a diameter exceeding a diameter of the proximal foam pad and the distal foam pad is of lesser foam density rating than the proximal foam pad.

In an aspect combinable with any other aspect described herein, the proximal foam pad has a first thickness.

In an aspect combinable with any other aspect described herein, the distal foam pad has a second thickness.

In an aspect combinable with any other aspect described herein, the distal foam pad includes a annular lip bordering an edge of the proximal foam pad, the annular lip including a width.

In an aspect combinable with any other aspect described herein, an annular lip of the distal foam pad may include a width exceeding the first thickness of the proximal foam pad.

In an aspect combinable with any other aspect described herein, the coupling member is adapted for orbital motion.

In an aspect combinable with any other aspect described herein, the massage device includes a tensionable bonnet including a material cover with a low coefficient of friction adapted for placement over the distal and proximal foam pads.

In an aspect combinable with any other aspect described herein, a tensionable bonnet when applied over the foam pads, is capable of deforming an annular edge of the distal foam pad into a curved disposition sufficient to cover an edge of the proximal foam pad.

In an aspect combinable with any other aspect described herein, an annular lip of the distal foam pad forms an relatively soft outer foam layer over a relatively firm foam member.

In an aspect combinable with any other aspect described herein, the distal and proximal foam pads are disc-shaped.

In an aspect combinable with any other aspect described herein, portions of a distal pad are attached to a circumference of the proximal pad and thereby form a rounded edge.

In an aspect combinable with any other aspect described herein, the massage device may include a variable speed control.

Other advantages of the present invention will become apparent from the following descriptions, taken in connection with the accompanying drawings wherein by way of illustration and example, preferred embodiments of the present invention are disclosed.

BRIEF DESCRIPTION OF THE DRAWING FIGURES

FIG. 3E is a cross-sectional view of the assembly shown in (FIG. 3D) once a bonnet is tensionably applied causing the distal pad to curve upwardly;

FIG. 4 shows an example massage device with a bonnet placed over the pad assembly members;

REFERENCE TO THE NUMBERED ELEMENTS

Figure 1:
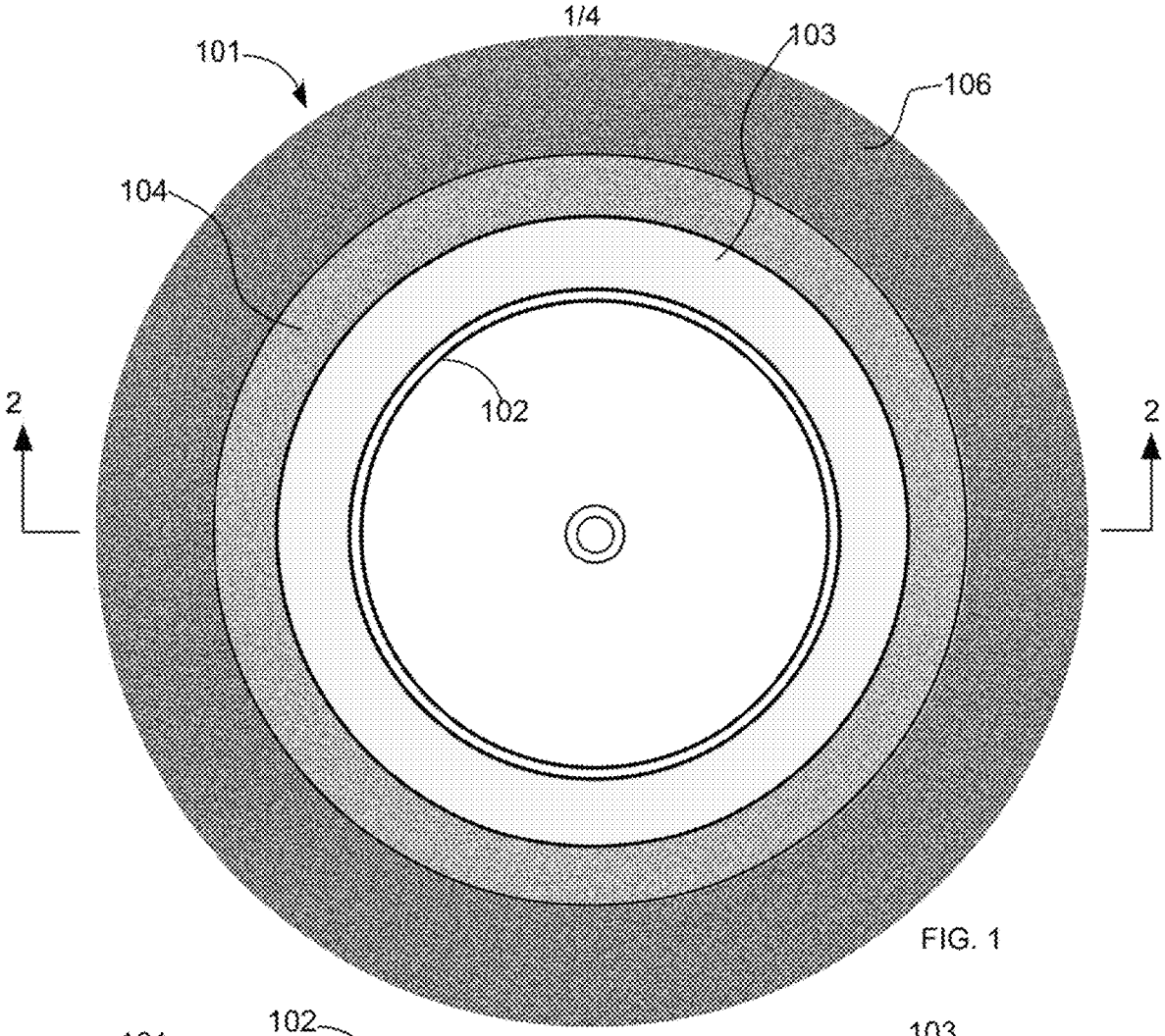
FIG. 1 is a top plan view of an example pad assembly.

100 massage device
101 pad assembly
102 coupling assembly
103 coupling assembly flange
104 proximal foam pad
105 intermediate foam pad
106 distal foam pad
107 annular lip
108 coupling member fastener recess
110 bonnet
112 elastic element
113 cinching member
114 powering motor
116 elliptical cam

Definitions

In the following description, unless otherwise explained, any technical terms used herein have the same meaning as commonly understood by one of ordinary skill in the art to which this disclosure belongs. The singular terms "a", "an", and "the" include plural referents unless the context clearly indicates otherwise. Similarly, the word "or" is intended to include "and" unless the context clearly indicates otherwise. Although methods and materials similar or equivalent to those described herein can be used in the practice or testing of this disclosure, suitable methods and materials are described below. The term "comprises" means "includes." All publications, patent applications, patents, and other references listed in this disclosure are incorporated by reference in their entirety for all purposes. In case of conflict, the present specification, including explanations of terms, will control. In addition, the materials, methods, and examples are illustrative only and not intended to be limiting.

DETAILED DESCRIPTION OF THE EMBODIMENTS

Referring generally to FIGS. 1-6, a general example implementation of a massage device (100) according to the present invention includes a powering motor (114) which may be a machine adapted (116) to produce an orbital-type movement, a pad assembly (101) including a coupling member (102) with a plate or flange (103), at least a proximal foam pad (104) connected to and adjacent the plate or flange, and a distal foam pad (106) attached to the proximal foam pad. ILD rating refers to "Indentation Load Deflection" and is a unit of measurement referring to the pounds of pressure required to indent foam to a depth of 4 inches by 25%. Typically, the distal foam pad (106) is a high-resilient (HR) type foam and includes a ILD rating of between 40 and 65 and is softer than that of the proximal foam pad. Note that ILD is typically a rating for polyurethane foam, but polyethylene or nitrile butadiene rubber foam (NBR) may be included or substituted for polyurethane foam in some implementations and may share physical characteristics substantially corresponding to particular ILD rating provided for the polyurethane foam. In some implementations, the distal foam pad may be a nitrile rubber and/or a polyvinyl chloride (PVC) foam. In some implementations, distal foam pad (106) includes an annular lip (107) that is set off, preferably ¾ to 1.5 inches from the proximal foam pad and configured to deform circumferentially such that the annular lip (107) is caused to curve up and over an edge of the proximal foam pad when a tensionable bonnet (110) is placed over the foam pads. In other implementations, a distal foam pad is attached circumferentially to an edge of the proximal foam pad by adhesive or other means that will be appreciated by those having skill in the art, thereby forming a curved bumper-like structure. In still other implementations, distal foam pad (106) is adhered both circumferentially and to a bottom of a proximal pad. Tensionable bonnet (110) may include an elastic neck element (112) or a cinching member (113); e.g., a draw-string element, such that when the bonnet is applied, a relatively soft layer of foam of the distal pad (106) is compressed over a relatively firm layer of the proximal foam pad (104) and the bonnet forms the body contacting portion of the device. Bonnet (110) includes a material/fabric such as tafetta with a low coefficient of friction; e.g., nylon, rayon, silk, polyester, acetate, that permits the bonneted foam pads to be applied over clothing without grabbing, such that the orbiting pads (104, 106) not only percuss the underlying muscle groups but also impart a comforting warmth to portions of the body being treated. In some implementations where the layers of foam are generally pre-formed into a curved shape (FIG. 3B, 3C), the tensionable bonnet still compresses the outer foam layer against the proximally disposed foam pad or intermediate foam pad if one is present.

Figure 2:
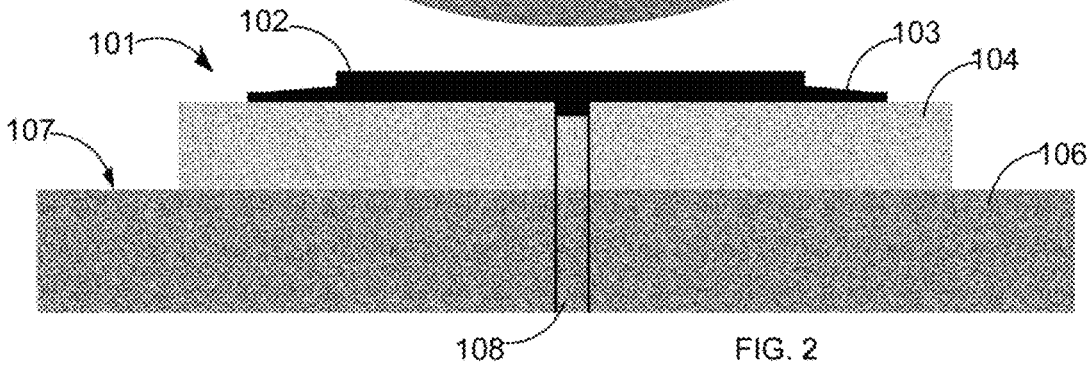
FIG. 2 is a cross-sectional view taken along lines 2-2 of (FIG. 1)

FIGS. 1 and 2 show respectively, a top plan view of an example pad assembly and a cross-sectional view taken along lines 2-2. Pad assembly (101) includes a coupling member (102) adapted to attach to a powered shaft of a motor (114) capable of orbital movement. Attached to the coupling member is a proximal foam pad (104) and a distal foam pad (106) with a diameter exceeding that of the proximal pad.

Figure 3A:
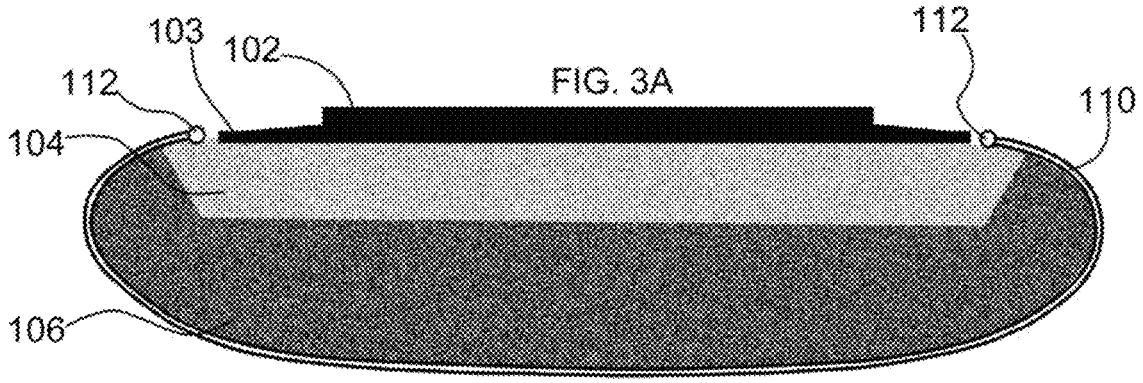
FIG. 3A is a cross-sectional view showing an example implementation including of a proximal and distal pad member when a bonnet is placed over the pad members.

FIG. 3A shows a cross-sectional view of the pad assembly of (FIG. 2) where a bonnet (110) is tightly placed over the pad assembly which results in proximal foam pad (104) being compressed laterally by the bonnet constricting the distal foam pad (106) and deformably curving the relatively soft distal foam pad upwardly against the relatively firm proximal foam pad. Accordingly, the body contacting edge of the pad assembly (101) is a hybrid foam construction ideally adapted for percussive use.

Figure 3B:
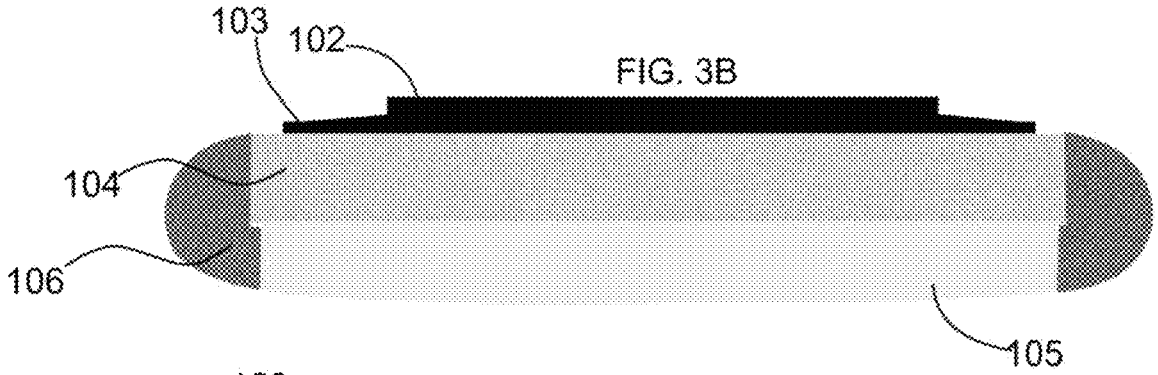
FIG. 3B is a cross-sectional view of another example implementation shown without a bonnet and in a normally curved state.
Figure 3C:
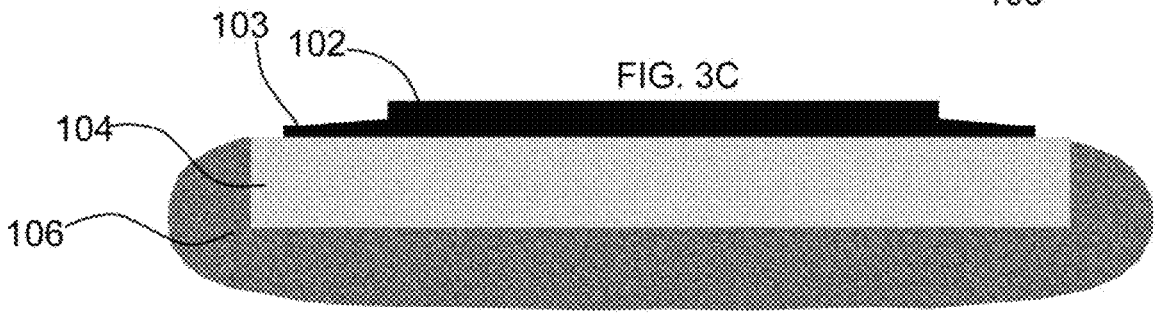
FIG. 3C is a cross-sectional view of yet another example implementation shown without a bonnet and in a normally curved state.
Figure 3D:
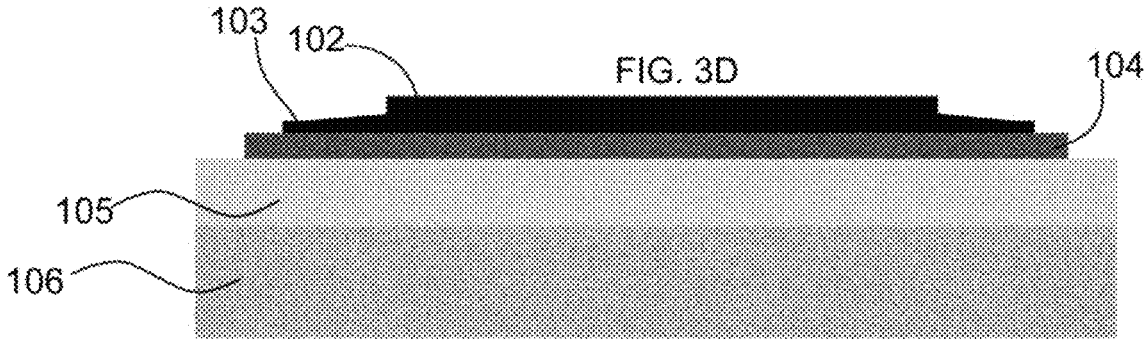
FIG. 3D is a cross-sectional view of a three pad configuration that includes a distal foam disc (106) with an ILD of 65, an intermediary foam disc with an ILD of 95 and a proximal foam disc with an ILD of at least 95.

FIG. 3B is another possible cross-sectional view of an example pad assembly that includes a group of centrally stacked foam pads pre-formed into a curved shape with a proximal pad (104) and an intermediate pad (105) that are circumferentially bounded by distal foam pad (106). FIG. 3C in yet another possible cross-sectional view shows a pad assembly pre-formed to a curved shape. Proximal foam pad (104) is surrounded at the sides and the bottom by distal foam pad (106). The proximal pad is typically a firm pad with an ILD rating of 70-95. In any of the foregoing examples, a bonnet (110) shaped and sized to tightly fit over the pad assembly may be lined with some cushioning material; a thin layer of foam or batting, etc., or, the bonnet may be unlined. FIG. 3D is a cross-sectional view of a three pad configuration that includes a distal foam disc (106) with an ILD of 65, an intermediary foam disc with an ILD of 95 and a proximal foam disc with an ILD of at least 95. FIG. 3E is a cross-sectional view of the assembly shown in (FIG. 3D) once a bonnet is tensionably applied causing the distal pad to curve upwardly.

Figure 5:
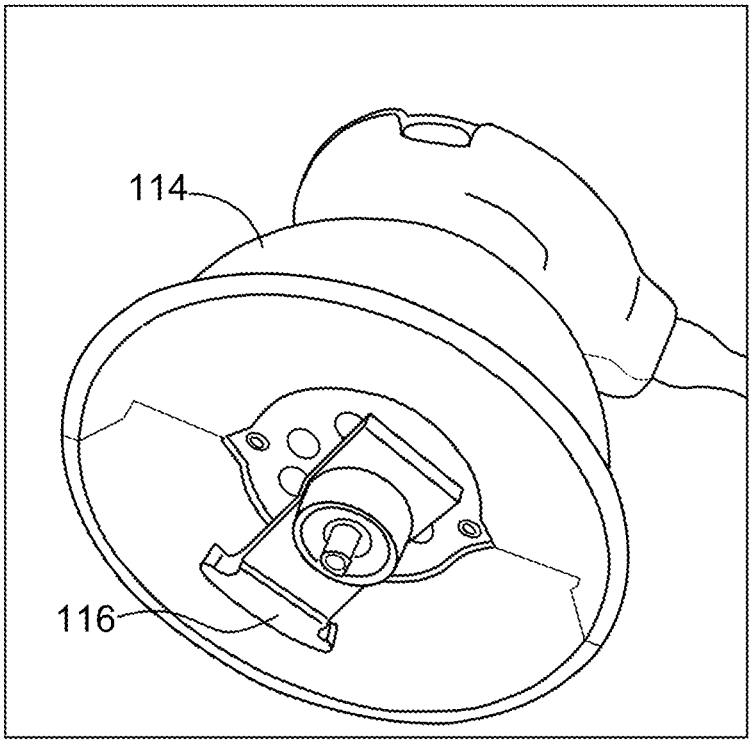
FIG. 5 shows an example power unit for a massage apparatus.
Figure 6:
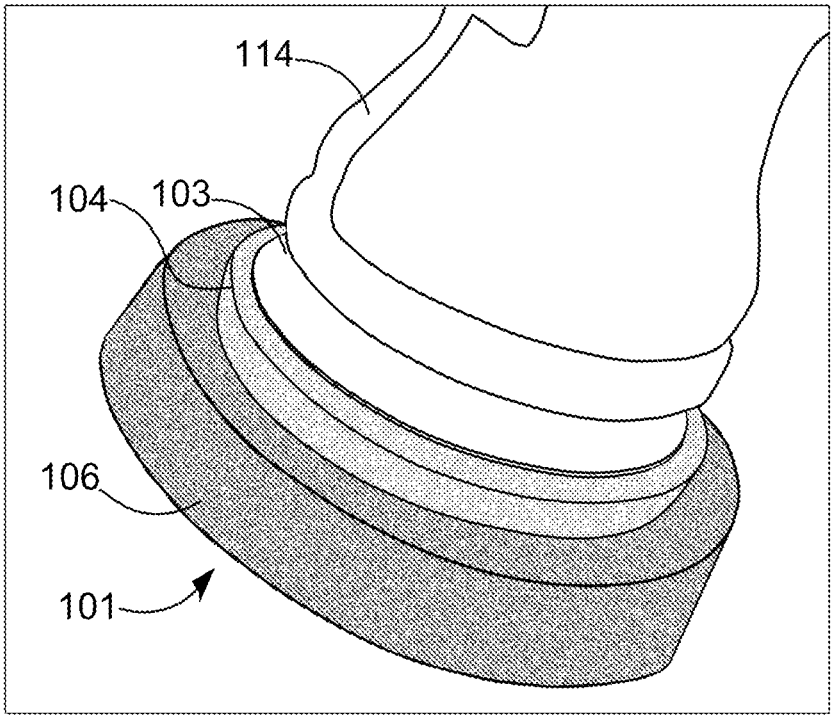
FIG. 6 shows the power unit of (FIG. 5) with mounted coupling unit and foam pads.

FIGS. 4 and 6 are perspective views of an example massage device showing respectively, a bonneted and unbonneted pad assembly (101). FIG. 5 shows one possible power output shaft having an orbital-type movement (116) whereby coupling member (102) and pad assembly (101) are attachable to a massage device.

It should be understood that it is conceivable that in some implementations, a convex structure of a relatively denser foam core with a fixed over molding of a relatively less dense foam may be suitable for use in an orbital-type massage device.

Accordingly, it is intended that this disclosure encompass any further modifications, changes, rearrangements, substitutions, alternatives, design choices, and embodiments as would be appreciated by those of ordinary skill in the art having benefit of this disclosure, and falling within the spirit and scope of the following claims.

What is claimed is:

1. A method of producing a massage device comprising the steps:

providing a coupling member adapted for attachment to a power output shaft;

providing a proximal disc of foam, the proximal disc of foam including a first density, a circumferential edge, a first diameter, and a first thickness;

providing a distal disc of foam joined to the proximal disc of foam, the distal disc of foam including a second density, a second diameter and an annular lip, the annular lip includes a width greater than the first thickness of the proximal disc such that when the annular lip is circumferentially deformed toward the proximal disc, it covers at least the circumferential edge and the distal and proximal discs of foam together form a convexity, and wherein the proximal and distal discs of foam are connected to the coupling member;

providing an attachable bonnet with a tensionable member sized and shaped to deform the annular lip of the distal disc of foam into the convexity and such that the annular lip covers the circumferential edge of the proximal disc of foam.

2. The method according to claim 1 further comprising the step of providing a linkage between the coupling member and the power output shaft configured for eccentric movement.

3. The method according to claim 1 wherein the tensionable member includes an elastic element.

4. The method according to claim 1 wherein an exterior surface of the bonnet is comprised of at least one of the following: nylon, rayon, silk, polyester, acetate.

5. The method according to claim 1 wherein the second density is of lesser density than the first density.

6. The method according to claim 1 wherein the distal disc of foam is a high-resilient type foam.

7. The method according to claim 1 further comprising the step of providing an intermediary foam disc disposed between the proximal disc and the distal disc.

* * * * *